United States Patent [19]

Ikeda et al.

[11] Patent Number: 4,813,852

[45] Date of Patent: Mar. 21, 1989

[54] DISCHARGE ARRANGEMENT OF A COMPRESSOR HAVING A PLURALITY OF COMPRESSION CHAMBERS

[75] Inventors: Hayato Ikeda; Isao Tsuzuki; Kazuhiro Ohta, all of Kariya, Japan

[73] Assignee: Kabushiki Kaisha Toyoda Jidoshokki Seisakusho, Aichi, Japan

[21] Appl. No.: 166,444

[22] Filed: Mar. 9, 1988

[30] Foreign Application Priority Data

Mar. 11, 1987 [JP] Japan ..... 62-036110[U]

[51] Int. Cl.[4] ..... F04B 1/06

[52] U.S. Cl. ..... 417/269; 417/362

[58] Field of Search ..... 417/312, 313, 269

[56] References Cited

U.S. PATENT DOCUMENTS

| | | | |
|---|---|---|---|
| 3,820,921 | 6/1974 | Thayer | 417/312 |
| 4,070,136 | 1/1978 | Nakayama et al. | 417/269 |
| 4,274,813 | 6/1981 | Kishi et al. | 417/269 |
| 4,407,638 | 10/1983 | Sasaya et al. | 417/269 |
| 4,583,922 | 4/1986 | Iijima et al. | 417/312 X |

FOREIGN PATENT DOCUMENTS

| | | | |
|---|---|---|---|
| 46063 | 3/1980 | Japan | 417/269 |
| 44481 | 4/1981 | Japan | 417/269 |
| 44783 | 3/1982 | Japan | 417/269 |

*Primary Examiner*—William L. Freeh

*Attorney, Agent, or Firm*—Burgess, Ryan & Wayne

[57] ABSTRACT

A compressor comprising a cylinder block having a plurality of compression chambers and a housing having a discharge chamber and an outlet port. The housing is mounted on the cylinder block through a valve plate having discharge ports for discharging fluid from the compression chambers into the discharge chamber. At least one bulkhead wall is provided in the housing, extending from a position near at least one of the discharge ports toward the outlet port for separating the at least one discharge port and an adjacent discharge port.

6 Claims, 3 Drawing Sheets

DISCHARGE ARRANGEMENT OF A COMPRESSOR HAVING A PLURALITY OF COMPRESSION CHAMBERS

BACKGROUND OF THE INVENTION

1. Field of the Invention

The present invention relates to a compressor having a plurality of compression chambers adapted for use in an air conditioning system, particularly, in an automobile, and more specifically, to a bulkhead discharge arrangement of such a compressor.

2. Description of the Related Art

Compressors having a plurality of compression chambers are known. For example, a swash plate type compressor has a plurality of cylinder bores with pistons inserted therein arranged around a center driving shaft, to thereby form a plurality of compression chambers. The swash plate type compressor comprises a cylinder block to form a plurality of cylinder bores, a valve plate covered on one end of the cylinder block and an end housing mounted on the cylinder block over the valve plate. The valve plate has a plurality of discharge valves for the compression chambers and the end housing forms a common discharge chamber; the compressed fluid flows from a plurality of compression chambers into the common discharge chamber and then discharges through an outlet port to the outside utility.

This discharge arrangement will advantageously enable the use of a single outlet port, although the compressor has a plurality of compression chambers. However, this discharge arrangement suffers from a problem in that an interference occurs in the discharge chamber due to the flow of the compressed fluids from different compression chambers The compressed fluid from the different compression chambers flows in different directions respectively, and the flows merge and impinge on each other, resulting in a decrease in the total discharge pressure. Also, a high frequency pulsation is caused by the superimposed flows of the fluid from the discharge port located near the outlet port in the end housing and another flow from the discharge port located remote from the outlet port, causing noise.

SUMMARY OF THE INVENTION

An object of the present invention is to provide a compressor with a plurality of compression chambers, which can solve the above described problems.

According to the present invention, there is provided a compressor comprising a cylinder block having a plurality of compression chambers formed therein, a housing having a discharge chamber formed therein and mounted on the cylinder block through a partition means, the partition means having discharge ports formed therethrough for discharging fluid from the compression chambers into the discharge chamber, the housing having an outlet port for discharging compressed fluid from the discharge chamber to an outside utility, and at least one bulkhead wall means in the housing, the at least one bulkhead wall means extending from a position near at least one of the discharge ports toward the outlet port for separating the at least one discharge port and the adjacent discharge port.

In the preferred form, the compressor comprises a cylinder block having a plurality of axially extending cylinder bores formed therein, pistons being slidably inserted in said cylinder bores, respectively, and a plate means covered on one end of the cylinder block to provide compression chambers within the cylinder bores between the plate means and the pistons, respectively, the plate means having discharge ports formed therethrough for discharging compressed fluid from the compression chambers and closeable by valve means, an end housing mounted on the cylinder block over the plate means, the end housing having a discharge chamber formed therein for receiving compressed fluid discharged through the discharge ports and an outlet port for discharging compressed fluid from the discharge chamber to an outside utility, and at least one bulkhead wall means in the end housing, the at least one bulkhead wall means extending from a position near at least one of the discharge ports toward the outlet port for separating the at least one discharge port and the adjacent discharge port.

With this arrangement, a plurality of separate fluid passage are formed in the discharge chamber by the at least one bulkhead wall means, along which the fluids discharged from the respective discharge ports are directed smoothly toward the outlet port, to thereby prevent the interference of the flow of the fluids.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENTS

Figure 1:
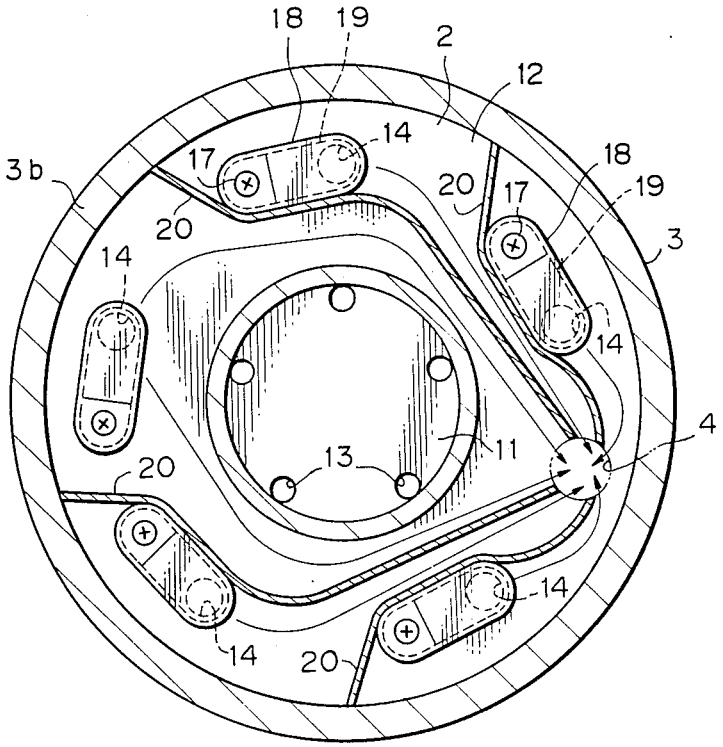
FIG. 1 is a transverse sectional view of a compressor according to the present invention, taken along the line 1—1 in FIG. 2.
Figure 2:
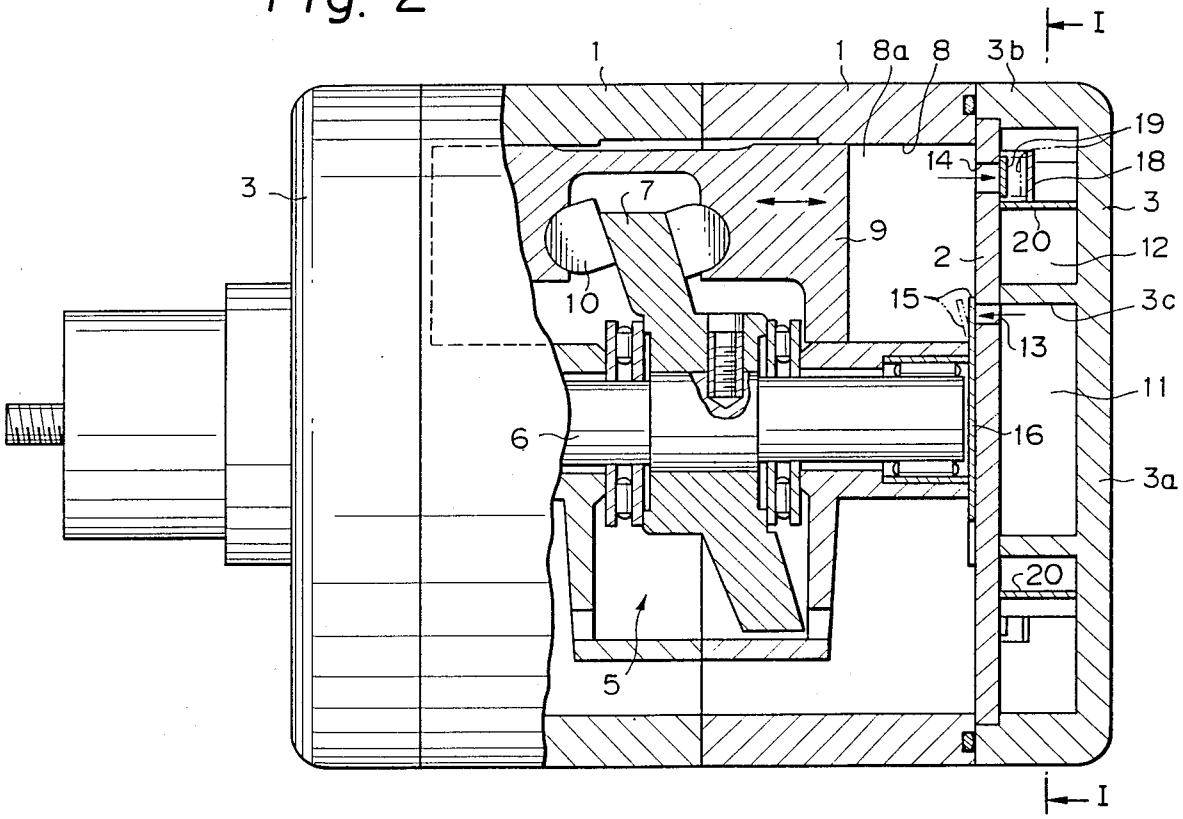
FIG. 2 is a longitudinal sectional view of the compressor of FIG. 1.

FIGS. 1 and 2 shows a swash plate type compressor according to the present invention, provided with five double headed pistons to thereby constitute ten compression chambers (a part of only one piston can be seen in FIG. 2).

As shown in FIG. 2, the compressor comprises a cylinder block 1 consisting of a pair of axially coupled cylinder block halves, partitions or valve plates 2 covered on either end of the cylinder block 1, and end housings 3 mounted on either end of the cylinder block 1 over the respective valve plates 2. The cylinder block 1 has a swash plate chamber 5 at central region thereof for placing a swash plate 7 therein. The swash plate 7 is carried by a rotatable drive shaft 6. The cylinder block 1 has five cylinder bores 8 (only one shown) located on a common circle at generally equidistant positions around the rotatable drive shaft 6, double headed pistons 9 being slidably inserted in the cylinder bores 8, respectively. As will be clear, compression chambers **8*a* are formed within the cylinder bores 8 on either side of the double headed pistons 9, to thereby constitute ten compression chambers 8*a*. Each piston 9 is engaged with the swash plate 7 through shoes 10, and thus can move reciprocally in the cylinder bore 8 upon the rotation of the swash plate 8**.

As shown in FIGS. 1 and 2, the end housing 3 comprises an end wall portion **3*a*** which is spaced from the valve plate 2, an outer circumferential side wall portion 3*b* which is coupled to the cylinder block 1, and an inner circumferential side wall portion 3*c*. The end housing 3 thus forms a suction chamber 11 within the inner circumferential side wall portion 3*c*, and a discharge chamber 12 between the outer and inner circumferential side wall portions 3*b* and 3*c*. The valve plate 2 has five suction ports 13 for introducing fluid to be compressed from the suction chamber 11 into each of the compression chambers 8*a* and five discharge ports 14 for discharging compressed fluid from each of the compression chambers 8*a* into the discharge chamber 12. FIG. 1 shows, by a phantom line, an outlet port 4 for discharging the compressed fluid to the outside utility, which is provided in the end wall portion 3*a* of the end housing 3 between the outer and inner circumferential side wall portions 3*b* and 3*c*.

The valve plate 2 has an elastic suction valve plate 16 carried on the side of the cylinder block 1, the suction valve plate 16 including suction valves 15 for opening and closing each of the suction ports 13. The valve plate 2 also has, on the side of the end housing 3, elastic discharge valves 19 for opening and closing each of the discharge ports 14 and tapering retainer plates 18 for restricting the lift of the discharge valves 9. Each of the retainer plates 18 has one end secured to the valve plate 2 by a screw 17 and the free end tapered divergently from the valve plate 2.

In this embodiment, four bulkhead walls 20 are provided in the end housing 3 for separating the discharge chamber 12 into a plurality of regions. The bulkhead walls 20 can be formed as an integral portion of the end housing 3 or of the valve plate 2. Alternatively, the bulkhead walls 20 can be formed as a unit or units, which can be appropriately assembled in the end housing 3. The bulkhead walls 20 have a height corresponding to a distance between the end wall portion 3*a* of the end housing 3 and the valve plate 2.

Each of the bulkhead walls 20 extends from a position near one of the discharge ports 14 toward the outlet port 4 and separates that discharge port 14 and the adjacent discharge port 14. Preferably, each of the bulkhead walls 20 extends from the outer circumferential side wall portion 3*b* at a position near one of the discharge ports 14, or between two adjacent discharge ports 14, to a position near the outlet port 4. It should be understood that five independent fluid passages are formed in the discharge chamber 12 by the bulkhead walls 20.

Figure 4:
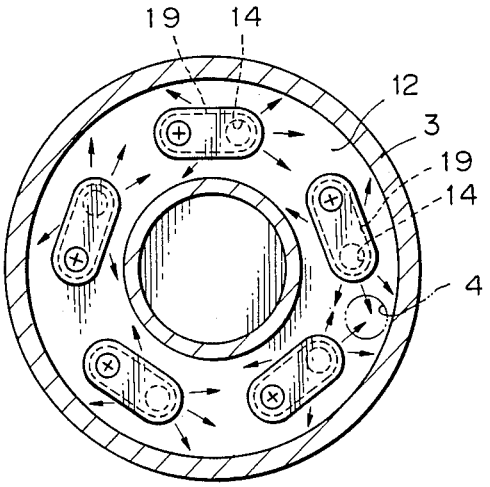
Fig. 4 PRIOR ART
FIG. 4 is a transverse sectional view of prior art.

In the operation of the illustrated swash plate type compressor, when the drive shaft 6 rotates together with the swash plate 7, the pistons 9 are moved reciprocally, alternatingly effecting suction and compression strokes and accompanying the opening and closing operation of the suction and discharge valves 15 and 19. The flows of the fluid are discharged from the five discharge ports 14 into the common discharge chamber 12, advance along the five independent fluid passages separated by the bulkhead walls 20, as shown by the arrows in FIG. 1, and then merge at outlet port 4. The compressed fluid is discharged from the outlet port 4 to an outside utility. This is compared with a discharge arrangement of prior art, as shown in FIG. 4, in which there is no bulkhead wall in the discharge chamber 12 and the flows from the discharge ports 14 are apt to disperse in the discharge chamber 12, as shown by the arrows in FIG. 4, and to impinge on or interfere with each other. According to the present invention, the flows of fluid from the five discharge ports 14 advance along the five independent fluid passages, and thus the occurrence of interference between the flows is substantially prevented due to the provision of the bulkhead walls 20. Therefore, it is possible to avoid a decrease in the resultant output pressure and a formation of a high frequency pulsation causing noise.

Figure 3:
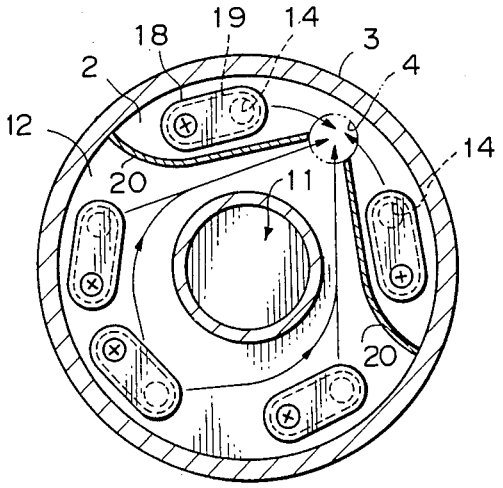
FIG. 3 is a transverse sectional view of a compressor according to a second embodiment of the present invention.

FIG. 3 shows a second embodiment of the present invention, in which only two bulkhead walls 20 are provided for separating the discharge ports 14 near the outlet port 4. This arrangement is also advantageous for preventing or at least mitigating the occurrence of interference of the flows, since it is believed that the interference problem is most serious when the flow from the discharge port 14 remote from the outlet port 4 and the flow from the discharge port 14 near the outlet port 4, merge.

While the present invention is described with reference to the illustrated embodiments, the present invention is not intended to be limited to such embodiments and it is possible to make numerous modifications within the scope of the present invention. For example, it is possible to change the number and shape of the bulkhead walls. It is also possible to change the disposition of the discharge chamber in the central region of the end housing with the bulkhead walls of the invention in the swash plate type compressor. Further, the discharge arrangement with the bulkhead walls of the invention can be applied to compressors other than the swash plate type compressor, such as a wobble plate type compressor or a vane type compressor.

We claim:

1. A compressor comprising:

a cylinder block having a plurality of compression chambers formed thereon, said compression chambers being axially extending bores;

pistons slidably movable in said chambers;

drive means for slidably moving said pistons in said chambers;

a housing having a discharge chamber and a suction chamber formed therein and mounted on said cylinder block through a partition means, said partition means having discharge ports formed therethrough for discharging fluid from said compression chambers into said discharge chamber and suction ports formed therethrough for introducing fluid from said suction chamber to said compression chambers, said housing having an outlet port for discharging compressed fluid from said discharge chamber to an outside utility and said housing including a boundary wall which separates said suction chamber and said discharge chamber;

inlet valves for selectively closing said suction ports;

discharge valves for selectively closing said discharge ports; and at least one bulkhead wall means in said housing, each said bulkhead wall means being separate from said boundary wall and extending from a position near at least one of said discharge ports toward said outlet port and terminating at a free end for separating said at least one discharge port and an adjacent discharge port.

2. A compressor comprising:

a cylinder block having a plurality of axially extending cylinder bores formed therein, pistons being slidably inserted in said cylinder bores, respectively;

drive means for slidably moving said pistons in said bores;

a plate means covered on one end of said cylinder block to provide compression chambers within said cylinder bores between said plate means and said pistons, respectively, said plate means having discharge ports formed therethrough for discharging compressed fluid from said compression chambers and closeable by discharge valve means and suction ports for supplying fluid to said compression chambers and closeable by suction valve means;

and end housing mounted on said cylinder block over said plate means, said end housing having a discharge chamber formed therein for receiving compressed fluid discharged through said discharge ports, a suction chamber for supplying fluid through said suction ports, an outlet port for discharging compressed fluid from said discharge chamber to an outside utility and a boundary wall which separates said suction chamber and said discharge chamber; and at least one bulkhead wall means in said end housing, each said bulkhead wall means being separate from said boundary wall and extending from a position near at least one of said discharge ports toward said outlet port and terminating at a free end for separating said at least one discharge port and the adjacent discharge port.

3. A compressor according to claim 2, wherein said end housing has an end wall portion which is spaced from said plate means and an outer circumferential side wall portion which is coupled to said cylinder block, said outlet port being formed in said end wall portion, said at least one bulkhead wall means having a height corresponding to a distance between said end wall portion and said plate means and extending from said outer circumferential side wall portion at a position near one of said discharge ports to a position near said outlet port.

4. A compressor according to claim 3, wherein said end housing further has an inner circumferential side wall portion, said discharge chamber being formed between said outer circumferential side wall portion and said inner circumferential side wall portion, said outlet port being formed at a position radially between said outer and inner circumferential side wall portions and circumferential intermediate between the two adjacent discharge ports.

5. A compressor comprising:

a cylinder block having a plurality of axially extending cylinder bores formed therein, pistons being slidably inserted in said cylinder bores, respectively;

drive means for slidably moving said pistons in said bores;

a plate means covered on one end of said cylinder block to provide compression chambers within said cylinder bores between said plate means and said piston, respectively, said plate means having discharge ports formed therethrough for discharging compressed fluid from said compression chambers and closeable by discharge valve means, and suction ports for supplying fluid to said compression chambers and closeable by suction valve means;

an end housing mounted on said cylinder block over said plate means, said end housing having a discharge chamber formed therein for receiving compressed fluid discharged through said discharge ports and an outlet port for discharging compressed fluid from said discharge chamber to an outside utility, said end housing having an end wall portion which is spaced from said plate means and an outer circumferential side wall portion which is coupled to said cylinder block, said outlet port being formed in said end wall portion, said at least one bulkhead wall means having a height corresponding to a distance between said end wall portion and said plate means and extending from said outer circumferential side wall portion at a position near one of said discharge ports to a position near said outlet port, said end housing further having an inner circumferential side wall portion, said discharge chamber being formed between said outer circumferential side wall portion and said inner circumferential side wall portion, said outlet port being formed at a position radially between said outer and inner circumferential side wall portions and circumferential intermediate between the two adjacent discharge ports;

at least one bulkhead wall means in said end housing, said at least one bulkhead wall means extending from a position near at least one of said discharge ports toward said outlet port for separating said at least one discharge port and the adjacent discharge port; and said plate means has discharge ports located on a common circle at generally equidistant positions and said at least one bulkhead wall means comprises a plurality of bulkhead walls which extend between the respective two adjacent discharge ports toward said outlet port.

6. A compressor comprising:

a cylinder block having a plurality of axially extending cylinder bores formed therein, pistons being slidably inserted in said cylinder bores, respectively;

drive means for slidably moving said pistons in said bores;

a plate means covered on one end of said cylinder block to provide compression chambers within said cylinder bores between said plate means and said pistons, respectively, said plate means having discharge ports formed therethrough for discharging compressed fluid from said compression chambers and closeable by discharge valve means and suction ports for supplying fluid to said compression chambers and closeable by suction valve means;

an end housing mounted on said cylinder block over said plate means, said end housing having a discharge chamber formed therein for receiving compressed fluid discharged through said discharge ports and an outlet port for discharging compressed fluid from said discharge chamber to an outside utility;

at least one bulkhead wall means in said end housing, said at least one bulkhead wall means extending from a position near at least one of said discharge ports toward said outlet port for separating said at least one discharge port and the adjacent discharge port; and said plate means has discharge ports located on a common circle at generally equidistant positions and said at least one bulkhead wall means comprises a plurality of bulkhead walls which extend between the respective two adjacent discharge ports toward said outlet port.

* * * * *